US010101678B2

(12) United States Patent
Kawasaki

(10) Patent No.: US 10,101,678 B2
(45) Date of Patent: Oct. 16, 2018

(54) ELECTROPHOTOGRAPHIC PHOTORECEPTOR, PROCESS CARTRIDGE, AND IMAGE-FORMING APPARATUS

(71) Applicant: FUJI XEROX CO., LTD., Tokyo (JP)

(72) Inventor: Akihiro Kawasaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/450,162

(22) Filed: Mar. 6, 2017

(65) Prior Publication Data

US 2018/0081286 A1 Mar. 22, 2018

(30) Foreign Application Priority Data

Sep. 21, 2016 (JP) ..... 2016-184326

(51) Int. Cl.

| | |
|---|---|
| ***G03G 5/047*** | (2006.01) |
| ***G03G 21/18*** | (2006.01) |
| ***G03G 5/05*** | (2006.01) |
| ***G03G 5/06*** | (2006.01) |
| ***G03G 5/147*** | (2006.01) |

(52) U.S. Cl.

CPC ..... *G03G 5/047* (2013.01); *G03G 5/0564* (2013.01); *G03G 5/062* (2013.01); *G03G 5/0607* (2013.01); *G03G 5/0618* (2013.01); *G03G 5/14791* (2013.01); *G03G 5/14795* (2013.01); *G03G 21/18* (2013.01)

(58) Field of Classification Search

CPC ..... G03G 5/14756; G03G 5/14795; G03G 5/0564

See application file for complete search history.

(56) References Cited

U.S. PATENT DOCUMENTS

| | | | |
|---|---|---|---|
| 5,298,617 | A | 3/1994 | Nukada et al. |
| 5,302,479 | A | 4/1994 | Daimon et al. |
| 5,459,004 | A | 10/1995 | Katsumi et al. |

FOREIGN PATENT DOCUMENTS

| | | | |
|---|---|---|---|
| EP | 0 710 893 | A1 | 5/1996 |
| JP | 04-189873 | A | 7/1992 |
| JP | 05-098181 | A | 4/1993 |
| JP | 05-140472 | A | 6/1993 |
| JP | 05-140473 | A | 6/1993 |
| JP | 05-263007 | A | 10/1993 |
| JP | 05-279591 | A | 10/1993 |

(Continued)

*Primary Examiner* — Peter L Vajda

(74) *Attorney, Agent, or Firm* — Sughrue Mion, PLLC

(57) ABSTRACT

An electrophotographic photoreceptor includes a conductive substrate and a photosensitive layer disposed on the conductive substrate which serves as an outermost surface of the electrophotographic photoreceptor. The electrophotographic photoreceptor satisfies YC−YA≥0.1 MPa, YC−YB≥0.1 MPa, and YC≤4.5 MPa, where YA, YB, and YC (MPa) represent the Young's moduli of a surface of the photosensitive layer determined by nanoindentation at an indentation depth of 500 nm at end portions A and B extending from a position 10 mm to a position 70 mm from the respective edges of the photosensitive layer toward the center of the photosensitive layer in an axial direction of the electrophotographic photoreceptor and a central portion C extending from a position 20 mm in front of and to a position 20 mm behind the center of the photosensitive layer in the axial direction of the electrophotographic photoreceptor, respectively.

11 Claims, 3 Drawing Sheets

(56) References Cited

FOREIGN PATENT DOCUMENTS

| | | | |
|---|---|---|---|
| JP | 08-176293 | A | 7/1996 |
| JP | 08-208820 | A | 8/1996 |
| JP | 2004-078147 | A | 3/2004 |
| JP | 2005-181992 | A | 7/2005 |
| JP | 2012-155282 | A | 8/2012 |
| JP | 2013-178367 | A | 9/2013 |

ELECTROPHOTOGRAPHIC PHOTORECEPTOR, PROCESS CARTRIDGE, AND IMAGE-FORMING APPARATUS

CROSS-REFERENCE TO RELATED APPLICATIONS

This application is based on and claims priority under 35 USC 119 from Japanese Patent Application No. 2016-184326 filed Sep. 21, 2016.

BACKGROUND

(i) Technical Field

The present invention relates to an electrophotographic photoreceptor, a process cartridge, and an image-forming apparatus.

(ii) Related Art

Electrophotographic image-forming apparatuses have been used as an image-forming apparatus included in a copying machine or a laser beam printer. Electrophotographic image-forming apparatuses include an electrophotographic photoreceptor.

Contact-developing image-forming apparatuses, which form a toner image by developing an electrostatic latent image formed on the surface of an electrophotographic photoreceptor with a developer held on the surface of a developer-holding member arranged to be in contact with the surface of the electrophotographic photoreceptor, are known.

In a contact-developing image-forming apparatus, end portions of a photosensitive layer in the axial direction of the electrophotographic photoreceptor, which are in contact with respective axial edges of the developer-holding member, may become worn.

SUMMARY

According to an aspect of the invention, there is provided an electrophotographic photoreceptor including a conductive substrate; and a photosensitive layer disposed on the conductive substrate, the photosensitive layer serving as an outermost surface of the electrophotographic photoreceptor. In the electrophotographic photoreceptor, YA, YB, and YC satisfy Formulae from (1) to (3) below:

$$YC-YA \geq 0.1 \text{ MPa} \quad (1)$$

$$YC-YB \geq 0.1 \text{ MPa} \quad (2)$$

$$YC \leq 4.5 \text{ MPa} \quad (3),$$

where YA, YB, and YC (MPa) each represent the Young's modulus of a surface of the photosensitive layer determined by nanoindentation at an indentation depth of 500 nm. The Young's modulus YA is measured at an end portion A of the photosensitive layer, the end portion A extending from a position 10 mm to a position 70 mm from an edge of the photosensitive layer toward the center of the photosensitive layer in an axial direction of the electrophotographic photoreceptor. The Young's modulus YB is measured at an another end portion B of the photosensitive layer, the end portion B extending from a position 10 mm to a position 70 mm from another edge of the photosensitive layer toward the center of the photosensitive layer in the axial direction of the electrophotographic photoreceptor. The Young's modulus YC is measured at a central portion C of the photosensitive layer, the central portion C extending from a position 20 mm in front of and to a position 20 mm behind the center of the photosensitive layer in the axial direction of the electrophotographic photoreceptor.

BRIEF DESCRIPTION OF THE DRAWINGS

Exemplary embodiments of the present invention will be described in detail based on the following figures, wherein.

DETAILED DESCRIPTION

Figure 1:
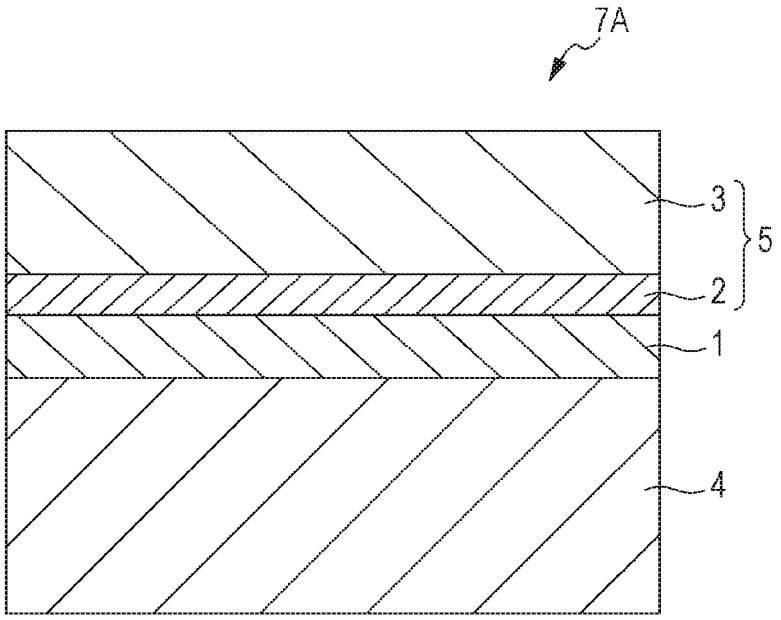
FIG. 1 is a schematic partial cross-sectional view of an electrophotographic photoreceptor according to an exemplary embodiment, illustrating an example of the arrangement of layers constituting the electrophotographic photoreceptor.

Exemplary embodiments of the invention are described below.

Electrophotographic Photoreceptor

Figure 4:
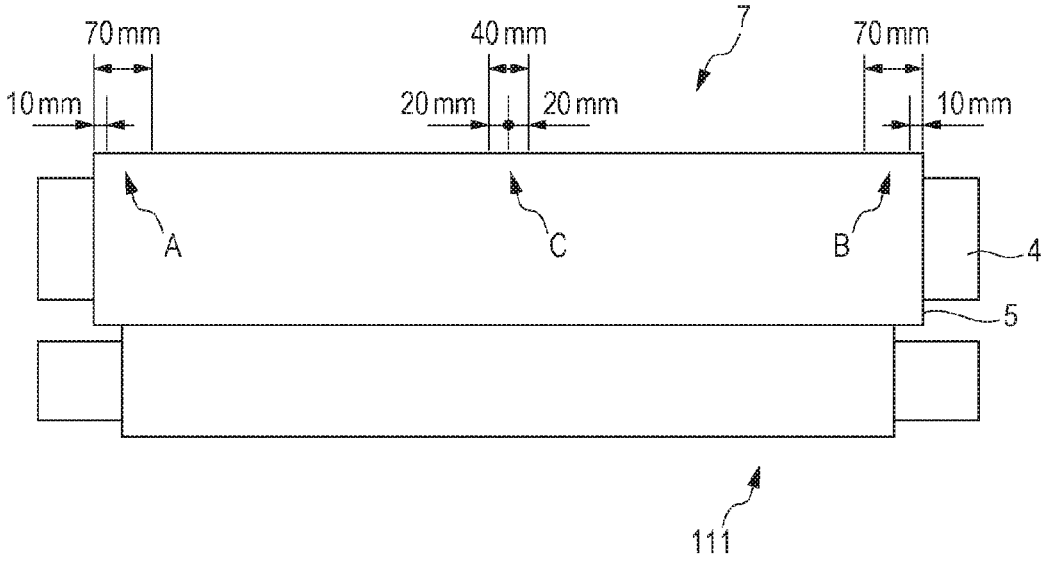
FIG. 4 is a schematic diagram illustrating the components of an electrophotographic photoreceptor according to an exemplary embodiment and the relationship between the electrophotographic photoreceptor and a developer-holding member that are in contact with each other.

An electrophotographic photoreceptor (hereinafter, referred to simply as "photoreceptor") according to an exemplary embodiment includes a conductive substrate and a photosensitive layer disposed on the conductive substrate. The photosensitive layer serves as an outermost layer of the photoreceptor. In the photoreceptor, YA, YB, and YC satisfy Formulae (1) to (3) below:

$$YC-YA \geq 0.1 \text{ MPa} \quad (1)$$

$$YC-YB \geq 0.1 \text{ MPa} \quad (2)$$

$$YC \geq 4.5 \text{ MPa} \quad (3),$$

where YA, YB, and YC (MPa) each represent the Young's modulus of the surface of the photosensitive layer determined by nanoindentation at an indentation depth of 500 nm; the Young's modulus YA is measured at an end portion A of the photosensitive layer which extends from a position 10 mm to a position 70 mm from an edge of the photosensitive layer toward the center of the photosensitive layer in the axial direction of the photoreceptor; the Young's modulus YB is measured at another end portion B of the photosensitive layer which extends from a position 10 mm to a position 70 mm from the other edge of the photosensitive layer toward the center of the photosensitive layer in the axial direction of the photoreceptor; and the Young's modulus YC is measured at a central portion C of the photosensitive layer which extends from a position 20 mm in front of and to a position 20 mm behind the center of the photosensitive layer in the axial direction of the photoreceptor (see FIG. 4).

The photoreceptor according to this exemplary embodiment may reduce the likelihood of the end portions of the photosensitive layer in the axial direction of the photoreceptor, which are in contact with respective axial edges of the developer-holding member, becoming worn. This is presumably because of the following reasons.

Contact-developing image-forming apparatuses, which form a toner image by developing an electrostatic latent image formed on the surface of a photoreceptor with a developer held on the surface of a developer-holding member arranged to be in contact with the surface of the photoreceptor, are known. In a contact-developing image-forming apparatus, end portions of a photosensitive layer in the axial direction of the photoreceptor, which are in contact with respective axial edges of the developer-holding member, may become worn.

This phenomenon is considered to be caused by the developer-holding member (e.g., a developing roller) being brought into contact with the surface of the photoreceptor (i.e., a photosensitive layer) while a load is applied to the axial end portions of the photoreceptor (see FIG. 4). Specifically, while the developer-holding member is in contact with the surface of the photoreceptor (i.e., a photosensitive layer), the axial edges of the developer-holding member are pressed against the photoreceptor (i.e., a photosensitive layer) at a higher pressure than the axial center of the developer-holding member.

If the end portions of the photosensitive layer in the axial direction of the photoreceptor become worn, the worn portions may fail to be charged to a sufficient degree. In such a case, streaky image defects (e.g., black strip-like image defects) may occur at end portions of a recording medium both in the transport direction and in a direction orthogonal to the transport direction.

Accordingly, the photoreceptor according to this exemplary embodiment satisfies Formulae (1) to (3) above. That is, the Young's modulus YA of the end portion A of the photosensitive layer and the Young's modulus YB of the other end portion B of the photosensitive layer are set to be smaller than the Young's modulus YC of the central portion C of the photosensitive layer, while the Young's modulus YC of the central portion C of the photosensitive layer is set to 4.5 MPa or less in order to maintain the abrasion resistance of the photosensitive layer included in the photoreceptor. This may enhance the abrasion resistance of the end portions of the photosensitive layer in the axial direction of the photoreceptor and reduce the likelihood of the end portions of the photosensitive layer in the axial direction of the photoreceptor, which are in contact with respective axial edges of the developer-holding member, becoming worn.

Since the likelihood of the end portions of the photosensitive layer in the axial direction of the photoreceptor becoming worn is reduced in the photoreceptor according to this exemplary embodiment, the occurrence of streaky image defects (e.g., black strip-like image defects), which may be caused as a result of the partial wearing of the photosensitive layer, may be reduced. In addition, setting the Young's modulus of the central portion C of the photosensitive layer to 4.5 MPa or less in order to enhance the abrasion resistance of the photosensitive layer included in the photoreceptor may increase the service life of the photoreceptor.

FIG. 4 illustrates an electrophotographic photoreceptor 7 that includes a conductive substrate 4 and a photosensitive layer 5 and a developing roller 111, that is, an example of a developer-holding member. In FIG. 4, "A" denotes the end portion A of the photosensitive layer; "B" denotes the other end portion B of the photosensitive layer; and "C" denotes the central portion C of the photosensitive layer.

In the photoreceptor according to this exemplary embodiment, the difference between the Young's modulus YC of the central portion C of the photosensitive layer and the Young's modulus YA of the end portion A of the photosensitive layer (hereinafter, referred to as "difference YC−YA") and the difference between the Young's modulus YC of the central portion C of the photosensitive layer and the Young's modulus YB of the other end portion B of the photosensitive layer (hereinafter, referred to as "difference YC−YB") are each 0.1 MPa or more and are each preferably 0.2 MPa or more in order to reduce the likelihood of the end portions of the photosensitive layer in the axial direction of the photoreceptor becoming worn.

The difference YC−YA and the difference YC−YB are each preferably 0.5 MPa or less and more preferably 0.4 MPa or less in order to reduce the occurrence of white strip-like image defects, which may be caused due to an excessive reduction in the occurrence of the partial wearing of the photosensitive layer.

The difference YC−YA and the difference YC−YB may be adjusted by, for example, drying the end portions of the photosensitive layer in the axial direction of the photoreceptor at a higher temperature than the central portion of the photosensitive layer in the axial direction of the photoreceptor (e.g., increasing the drying temperature to 110° C. or more and 150° C. or less) in the formation of a layer that serves as an outermost sublayer of the photosensitive layer (i.e., a charge-transporting layer or the like in the case where the photosensitive layer is a multilayer photosensitive layer, or a single-layer photosensitive layer in the case where the photosensitive layer is a single-layer photosensitive layer).

Figure 5:
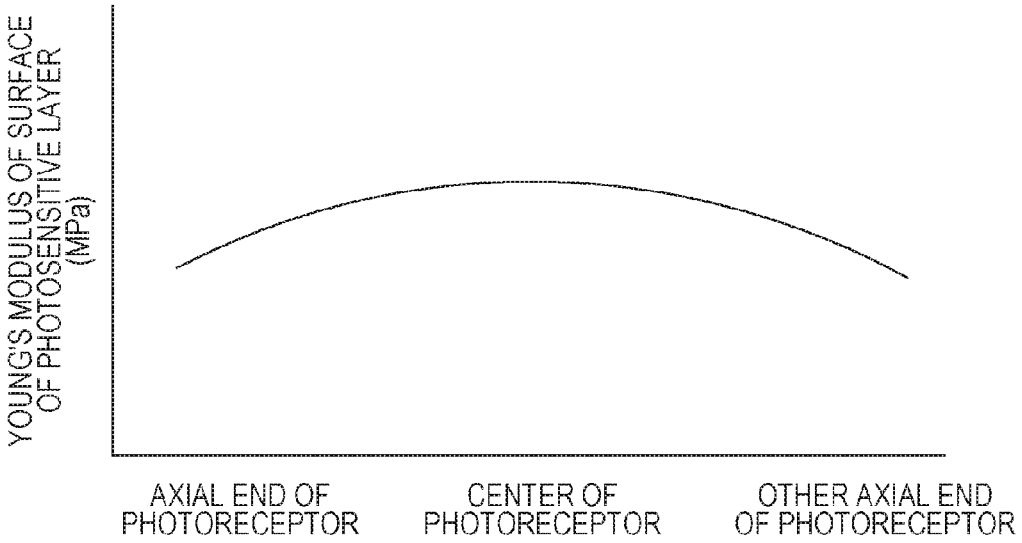
FIG. 5 is a schematic diagram illustrating an example of the change in the Young's modulus of the surface of a photosensitive layer included in an electrophotographic photoreceptor according to an exemplary embodiment in the axial direction of the photoreceptor.

Accordingly, the Young's modulus of the surface of the photosensitive layer may be increased in the directions from the end portion A of the photosensitive layer and the other end portion B of the photosensitive layer toward the central portion C of the photosensitive layer in consideration of the production process (see FIG. 5).

The Young's modulus YC of the central portion C of the photosensitive layer is preferably 4.5 MPa or less and is more preferably 4.4 MPa or less in order to limit a reduction in the service life of the photoreceptor.

The Young's modulus YC of the central portion C of the photosensitive layer is preferably 4.0 MPa or more and is more preferably 4.1 MPa or more in order to reduce the likelihood of faulty cleaning being caused due to an increase in viscosity.

The Young's modulus YC of the central portion C of the photosensitive layer may be adjusted by, for example, 1) changing the drying temperature (e.g., setting the temperature at which the central portion C of the photoreceptor is dried to at least 110° C. or more and 150° C. or less) in the formation of a layer that serves as an outermost sublayer of the photosensitive layer (i.e., a charge-transporting layer or the like in the case where the photosensitive layer is a multilayer photosensitive layer, or a single-layer photosensitive layer in the case where the photosensitive layer is a single-layer photosensitive layer) or 2) changing the composition of a layer that serves as an outermost sublayer of the photosensitive layer, such as the type and the molecular weight of the binder resin used, the type and the content of the filler used, and the type and the content of the retained solvent.

The Young's modulus of the surface of the photosensitive layer is determined by nanoindentation at an indentation depth of 500 nm. The specific method for determining Young's modulus is described below.

An indentation depth-load curve is measured with "PICODENTOR HM500" produced by Fischer Instruments K.K. and a Berkovich diamond indenter. The load is applied such that the maximum indentation depth of 500 nm is achieved. Subsequently, unloading is performed. The slope of the resulting unloading curve is considered to be the Young's modulus of the surface of the photosensitive layer.

The Young's modulus YA (MPa) of the end portion A of the photosensitive layer is determined in the following manner. The average of the Young's moduli of the surface of the photosensitive layer which are measured at positions 10 mm, 40 mm, and 70 mm from an edge of the photosensitive layer toward the center of the photosensitive layer in the axial direction of the photoreceptor is calculated. This calculation is performed 4 times in the direction in which the photoreceptor rotates (i.e., the circumferential direction) at intervals of 90°, and the average thereof is considered to be the Young's modulus YA (MPa) of the end portion A of the photosensitive layer.

The Young's modulus YB (MPa) of the other end portion B of the photosensitive layer is determined in the following manner. The average of the Young's moduli of the surface of the photosensitive layer which are measured at positions 10 mm, 40 mm, and 70 mm from the other edge of the photosensitive layer toward the center of the photosensitive layer in the axial direction of the photoreceptor is calculated. This calculation is performed 4 times in the direction in which the photoreceptor rotates (i.e., the circumferential direction) at intervals of 90°, and the average thereof is considered to be the Young's modulus YB (MPa) of the other end portion B of the photosensitive layer.

The Young's modulus YC (MPa) of the central portion C of the photosensitive layer is determined in the following manner. The average of the Young's moduli of the surface of the photosensitive layer which are measured at the center the photosensitive layer in the axial direction of the photoreceptor and positions 20 mm behind and in front of the center of the photosensitive layer is calculated. This calculation is performed 4 times in the direction in which the photoreceptor rotates (i.e., the circumferential direction) at intervals of 90°, and the average thereof is considered to be the Young's modulus YC (MPa) of the central portion C of the photosensitive layer.

The electrophotographic photoreceptor according to this exemplary embodiment is described below with reference to the attached drawings.

FIG. 1 is a schematic partial cross-sectional view of an electrophotographic photoreceptor 7A according to this exemplary embodiment, illustrating an example of the arrangement of layers constituting the photoreceptor. The electrophotographic photoreceptor 7A illustrated in FIG. 1 has a structure including a conductive substrate 4, an undercoat layer 1, a charge-generating layer 2, and a charge-transporting layer 3 that are stacked on top of one another in this order. The charge-generating layer 2 and the charge-transporting layer 3 constitute a photosensitive layer 5. In the electrophotographic photoreceptor 7A, the charge-transporting layer 3 serves as an outermost layer.

The electrophotographic photoreceptor 7A does not necessarily include the undercoat layer 1. The electrophotographic photoreceptor 7A may be a photoreceptor including a single-layer photosensitive layer that has both the function of the charge-generating layer 2 and the function of the charge-transporting layer 3. In a photoreceptor including the single-layer photosensitive layer, the single-layer photosensitive layer serves as an outermost layer.

The components of the electrophotographic photoreceptor are each described below. Hereinafter, the reference numerals of the components of the electrophotographic photoreceptor are omitted.

Conductive Base

Examples of the conductive substrate include a metal sheet, a metal drum, and a metal belt that are made of a metal such as aluminum, copper, zinc, chromium, nickel, molybdenum, vanadium, indium, gold, or platinum or an alloy such as stainless steel. Other examples of the conductive substrate include a paper sheet, a resin film, and a belt on which a conductive compound such as a conductive polymer or indium oxide, a metal such as aluminum, palladium, or gold, or an alloy is deposited by coating, vapor deposition, or lamination. The term "conductive" used herein refers to having a volume resistivity of less than $10^{13}$ Ωcm.

In the case where the electrophotographic photoreceptor is used as a component of a laser printer, the surface of the conductive substrate may be roughened such that the center-line average roughness Ra of the surface of the conductive substrate is 0.04 μm or more and 0.5 μm or less in order to reduce the likelihood of interference fringes being formed when the photoreceptor is irradiated with a laser beam. On the other hand, it is not necessary to roughen the surface of the conductive substrate in order to reduce the formation of interference fringes in the case when an incoherent light source is used. However, roughening the surface of the conductive substrate may increase the service life of the photoreceptor by reducing the occurrence of defects caused by the irregularities formed in the surface of the conductive substrate.

For roughening the surface of the conductive substrate, for example, the following methods may be employed: wet honing in which a suspension prepared by suspending abrasive particles in water is blown onto the surface of the conductive substrate; centerless grinding in which the conductive substrate is continuously ground with rotating grinding wheels brought into pressure contact with the conductive substrate; and an anodic oxidation treatment.

Another example of the roughening method is a method in which, instead of roughening the surface of the conductive substrate, a layer is formed on the surface of the conductive substrate by using a resin including conductive or semiconductive powder particles dispersed therein such that a rough surface is formed due to the particles dispersed in the layer.

In a roughening treatment using anodic oxidation, an oxidation film is formed on the surface of a conductive substrate made of a metal such as aluminum by performing anodic oxidation using the conductive substrate as an anode in an electrolyte solution. Examples of the electrolyte solution include a sulfuric acid solution and an oxalic acid solution. A porous anodic oxidation film formed by anodic oxidation is originally chemically active and likely to be contaminated. In addition, the resistance of the porous anodic oxidation film is likely to fluctuate widely with the environment. Accordingly, the porous anodic oxidation film may be subjected to a pore-sealing treatment in which micropores formed in the oxide film are sealed using volume expansion caused by a hydration reaction of the oxidation film in steam under pressure or in boiled water that may include a salt of a metal such as nickel so as to be converted into a more stable hydrous oxide film.

The thickness of the anodic oxidation film may be, for example, 0.3 μm or more and 15 μm or less. When the thickness of the anodic oxidation film falls within the above range, the anodic oxidation film may serve as a barrier to injection. Furthermore, an increase in the potential that remains on the photoreceptor after the repeated use of the photoreceptor may be limited.

The conductive substrate may be subjected to a treatment in which an acidic treatment liquid is used or a boehmite treatment.

The treatment in which an acidic treatment liquid is used is performed in, for example, the following manner. An acidic treatment liquid that includes phosphoric acid, chromium acid, and hydrofluoric acid is prepared. The proportions of the amounts of phosphoric acid, chromium acid, and hydrofluoric acid in the acidic treatment liquid may be, for example, 10% by weight or more and 11% by weight or less, 3% by weight or more and 5% by weight or less, and 0.5% by weight or more and 2% by weight or less, respectively. The total concentration of the above acids may be 13.5% by weight or more and 18% by weight or less. The treatment temperature may be, for example, 42° C. or more and 48° C. or less. The thickness of the resulting coating film may be 0.3 μm or more and 15 μm or less.

In the boehmite treatment, for example, the conductive substrate is immersed in pure water having a temperature of 90° C. or more and 100° C. or less for 5 to 60 minutes or brought into contact with steam having a temperature of 90° C. or more and 120° C. or less for from 5 to 60 minutes. The thickness of the resulting coating film may be 0.1 μm or more and 5 μm or less. The coating film may optionally be subjected to an anodic oxidation treatment with an electrolyte solution in which the coating film is hardly soluble, such as adipic acid, boric acid, a boric acid salt, a phosphoric acid salt, a phthalic acid salt, a maleic acid salt, a benzoic acid salt, a tartaric acid salt, or a citric acid salt.

Undercoat Layer

The undercoat layer includes, for example, inorganic particles and a binder resin.

The inorganic particles may have, for example, a powder resistivity (i.e., volume resistivity) of $10^2$ Ωcm or more and $10^{11}$ Ωcm or less.

Among such inorganic particles having the above resistivity, for example, metal oxide particles such as tin oxide particles, titanium oxide particles, zinc oxide particles, and zirconium oxide particles are preferable and zinc oxide particles are particularly preferable.

The BET specific surface area of the inorganic particles may be, for example, 10 $m^2/g$ or more.

The volume-average diameter of the inorganic particles may be, for example, 50 nm or more and 2,000 nm or less and is preferably 60 nm or more and 1,000 nm or less.

The content of the inorganic particles is preferably, for example, 10% by weight or more and 80% by weight or less and is more preferably 40% by weight or more and 80% by weight or less of the amount of binder resin.

The inorganic particles may optionally be subjected to a surface treatment. It is possible to use two or more types of inorganic particles which have been subjected to different surface treatments or have different diameters in a mixture.

Examples of an agent used in the surface treatment include a silane coupling agent, a titanate coupling agent, an aluminum coupling agent, and a surfactant. In particular, a silane coupling agent is preferable, and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in a mixture. For example, a silane coupling agent including an amino group may be used in combination with another type of silane coupling agent. Examples of the other type of silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

A method for treating the surface of the inorganic particles with the surface-treating agent is not limited, and any known surface treatment method may be employed. Both dry process and wet process may be employed.

The amount of surface-treating agent used may be, for example, 0.5% by weight or more and 10% by weight or less of the amount of inorganic particles.

The undercoat layer may include an electron-accepting compound (i.e., acceptor compound) in addition to the inorganic particles in order to enhance the long-term stability of electrical properties and carrier-blocking property.

Examples of the electron-accepting compound include the following electron-transporting substances: quinones such as chloranil and bromanil; tetracyanoquinodimethanes; fluorenones such as 2,4,7-trinitrofluorenone and 2,4,5,7-tetranitro-9-fluorenone; oxadiazoles such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones such as 3,3',5,5'-tetra-t-butyldiphenoquinone.

In particular, compounds including an anthraquinone structure may be used as an electron-accepting compound. Examples of the compounds including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron-accepting compound included in the undercoat layer may be dispersed in the undercoat layer together with the inorganic particles or deposited on the surfaces of the inorganic particles.

For depositing the electron-accepting compound on the surfaces of the inorganic particles, for example, a dry process or a wet process may be employed.

In a dry process, for example, while the inorganic particles are stirred with a mixer or the like capable of producing a large shearing force, the electron-accepting compound or a solution prepared by dissolving the electron-accepting compound in an organic solvent is added dropwise or sprayed together with dry air or a nitrogen gas to the inorganic particles in order to deposit the electron-accepting compound on the surfaces of the inorganic particles. The addition or spraying of the electron-accepting compound may be done at a temperature equal to or lower than the boiling point of the solvent used.

Subsequent to the addition or spraying of the electron-accepting compound, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved.

In a wet process, for example, while the inorganic particles are dispersed in a solvent with a stirrer, an ultrasonic wave, a sand mill, an Attritor, a ball mill, or the like, the electron-accepting compound is added to the dispersion liquid. After the resulting mixture has been stirred or dispersed, the solvent is removed such that the electron-accepting compound is deposited on the surfaces of the inorganic particles. The removal of the solvent may be done by, for example, filtration or distillation.

Subsequent to the removal of the solvent, the resulting inorganic particles may optionally be baked at 100° C. or more. The temperature at which the inorganic particles are baked and the amount of time during which the inorganic particles are baked are not limited; the inorganic particles may be baked under appropriate conditions of temperature and time under which the intended electrophotographic properties are achieved. In the wet process, moisture contained in the inorganic particles may be removed prior to the addition of the electron-accepting compound. The removal of moisture contained in the inorganic particles may be done by, for example, heating the inorganic particles while being stirred in the solvent or by bringing the moisture to the boil together with the solvent.

The deposition of the electron-accepting compound may be done prior or subsequent to the surface treatment of the inorganic particles with the surface-treating agent. Alternatively, the deposition of the electron-accepting compound and the surface treatment using the surface-treating agent may be performed at the same time.

The content of the electron-accepting compound may be, for example, 0.01% by weight or more and 20% by weight or less and is preferably 0.01% by weight or more and 10% by weight or less of the amount of inorganic particles.

Examples of the binder resin included in the undercoat layer include the following known materials: known high-molecular compounds such as an acetal resin (e.g., polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenolic resin, a phenol-formaldehyde resin, a melamine resin, a urethane resin, an alkyd resin, and an epoxy resin; zirconium chelates; titanium chelates; aluminum chelates; titanium alkoxides; organic titanium compounds; and silane coupling agents.

Other examples of the binder resin included in the undercoat layer include charge-transporting resins including a charge-transporting group and conductive resins such as polyaniline.

Among the above binder resins, a resin insoluble in a solvent included in a coating liquid used for forming a layer on the undercoat layer may be used as a binder resin included in the undercoat layer. In particular, resins produced by reacting at least one resin selected from the group consisting of thermosetting resins (e.g., a urea resin, a phenolic resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio between the binder resins may be set appropriately.

The undercoat layer may include various additives in order to enhance electrical properties, environmental stability, and image quality.

Examples of the additives include the following known materials: electron-transporting pigments such as polycondensed pigments and azo pigments, zirconium chelates, titanium chelates, aluminum chelates, titanium alkoxides, organic titanium compounds, and silane coupling agents. The silane coupling agents, which are used in the surface treatment of the inorganic particles as described above, may also be added to the undercoat layer as an additive.

Examples of silane coupling agents that may be used as an additive include vinyltrimethoxysilane, 3-methacryloxypropyl-tris(2-methoxyethoxy)silane, 2-(3,4-epoxycyclohexyl) ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine, and polyhydroxy titanium stearate.

Examples of the aluminum chelates include aluminum isopropylate, monobutoxy aluminum diisopropylate, aluminum butyrate, diethyl acetoacetate aluminum diisopropylate, and aluminum tris(ethyl acetoacetate).

The above additives may be used alone. Alternatively, two or more types of the above additives may be used in a mixture or in the form of a polycondensate.

The undercoat layer may have a Vickers hardness of 35 or more.

In order to reduce the formation of moiré fringes, the surface roughness (i.e., ten-point-average roughness) of the undercoat layer may be adjusted to $1/(4n)$ to ½ of the wavelength $\lambda$ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be polished in order to adjust the surface roughness of the undercoat layer. For polishing the surface of the undercoat layer, buffing, sand blasting, wet honing, grinding, and the like may be performed.

A method for forming the undercoat layer is not limited, and known methods may be employed. For example, a coating film is formed using a coating liquid (hereinafter, referred to as "undercoat-layer-forming coating liquid")

prepared by mixing the above-described components with a solvent, and the coating film is dried and, as needed, heated.

Examples of the solvent used for preparing the undercoat-layer-forming coating liquid include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat-layer-forming coating liquid, for example, known equipment such as a roll mill, a ball mill, a vibrating ball mill, an Attritor, a sand mill, a colloid mill, and a paint shaker may be used.

For coating the conductive substrate with the undercoat-layer-forming coating liquid, for example, common methods such as blade coating, wire bar coating, spray coating, dip coating, bead coating, air knife coating, and curtain coating may be employed.

The thickness of the undercoat layer is preferably, for example, 15 μm or more and is more preferably 20 μm or more and 50 μm or less.

Intermediate Layer

Although not illustrated in the drawings, an intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound included in the intermediate layer include organometallic compounds containing a metal atom such as a zirconium atom, a titanium atom, an aluminum atom, a manganese atom, or a silicon atom.

The above compounds included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

A method for forming the intermediate layer is not limited, and known methods may be employed. For example, a coating film is formed using an intermediate-layer-forming coating liquid prepared by mixing the above-described components with a solvent, and the coating film is dried and, as needed, heated.

For forming the intermediate layer, common coating methods such as dip coating, push coating, wire bar coating, spray coating, blade coating, knife coating, and curtain coating may be employed.

The thickness of the intermediate layer may be, for example, 0.1 μm or more and 3 μm or less. It is possible to use the intermediate layer also as an undercoat layer.

Charge-Generating Layer

The charge-generating layer includes, for example, a charge-generating material and a binder resin. The charge-generating layer may be formed by the vapor deposition of the charge-generating material. A charge-generating layer formed by the vapor deposition of a charge-generating material may be used particularly in the case where an incoherent light source such as a light-emitting diode (LED) or an organic electroluminescence (EL) image array is used.

Examples of the charge-generating material include azo pigments such as bisazo and trisazo; annulated aromatic pigments such as dibromoanthanthrone; perylene pigments; pyrrolopyrrole pigments; phthalocyanine pigments; zinc oxide; and trigonal selenium.

Among the above charge-generating materials, in particular, a metal phthalocyanine pigment or a nonmetal phthalocyanine pigment may be used in consideration of exposure to a laser beam in the near-infrared region. Specific examples of such charge-generating materials include hydroxygallium phthalocyanine, chlorogallium phthalocyanine, dichloro tin phthalocyanine, and titanyl phthalocyanine.

Among the above-charge-generating materials, annulated aromatic pigments such as dibromoanthanthrone; thioindigo pigments; porphyrazines; zinc oxide; trigonal selenium; and bisazo pigments may be used in consideration of exposure to a laser beam in the near-ultraviolet region.

The above charge-generating materials may be used also in the case where an incoherent light source such as an LED or an organic EL image array, which emits light having a center wavelength of 450 nm or more and 780 nm or less, is used. However, when the thickness of the photosensitive layer is reduced to 20 μm or less in order to increase the resolution, the strength of the electric field in the photosensitive layer may be increased. This increases the occurrence of a reduction in the amount of charge generated due to the injection of charge from the substrate, that is, image defects referred to as "black spots". This becomes more pronounced when a p-type semiconductor that is likely to induce a dark current, such as trigonal selenium or a phthalocyanine pigment, is used as a charge-generating material.

In contrast, in the case where an n-type semiconductor such as an annulated aromatic pigment, a perylene pigment, or an azo pigment is used as a charge-generating material, the dark current is hardly induced and the occurrence of the image defects referred to as "black spots", may be reduced even when the thickness of the photosensitive layer is reduced.

Whether or not a charge-generating material is n-type is determined on the basis of the polarity of the photoelectric current that flows in the charge-generating material by a commonly used time-of-flight method.

Specifically, a charge-generating material in which electrons are more easily transmitted as carriers than holes is determined to be n-type.

The binder resin included in the charge-generating layer is selected from various insulating resins. The binder resin may also be selected from organic photoconductive polymers such as poly-N-vinylcarbazole, polyvinyl anthracene, polyvinylpyrene, and polysilane.

Specific examples of the binder resin include a polyvinyl butyral resin, a polyarylate resin (e.g., polycondensate of a bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinylpyrrolidone resin. The term "insulating" used herein refers to having a volume resistivity of $10^{13}$ Ωcm or more.

The above binder resins may be used alone or in a mixture of two or more.

The ratio of the amount of charge-generating material to the amount of binder resin may be 10:1 to 1:10 by weight.

The charge-generating layer may optionally include known additives.

A method for forming the charge-generating layer is not limited, and any known method may be employed. For example, the above components are dissolved in a solvent in order to form a coating liquid used for forming the charge-generating layer (hereinafter, referred to as "charge-generating-layer-forming coating liquid"). The charge-generating-layer-forming coating liquid is formed into a coating film, which is dried and, as needed, subsequently heated. Alternatively, the charge-generating layer may be formed by the vapor deposition of the charge-generating material. The charge-generating layer may be formed by the vapor deposition particularly when the charge-generating material is an annulated aromatic pigment or a perylene pigment.

Examples of the solvent used for preparing the charge-generating-layer-forming coating liquid include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. The above solvents may be used alone or in a mixture of two or more.

For dispersing particles of the charge-generating material or the like in the charge-generating-layer-forming coating liquid, for example, media dispersing machines such as a ball mill, a vibrating ball mill, an Attritor, a sand mill, and a horizontal sand mill; and medialess dispersing machines such as a stirrer, an ultrasonic wave disperser, a roll mill, and a high-pressure homogenizer may be used. Specific examples of the high-pressure homogenizer include an impact-type homogenizer in which a dispersion is brought into collision with a liquid or a wall under a high-pressure condition in order to perform dispersion; and a through-type homogenizer in which a dispersion is passed through a very thin channel under a high-pressure condition in order to perform dispersion.

The average diameter of the particles of the charge-generating material dispersed in the charge-generating-layer-forming coating liquid may be 0.5 μm or less, is preferably 0.3 μm or less, and is further preferably 0.15 μm or less.

For applying the charge-generating-layer-forming coating liquid to the undercoat layer (or, the intermediate layer), for example, common coating methods such as blade coating, wire bar coating, spray coating, dip coating, bead coating, air knife coating, and curtain coating may be employed.

The thickness of the charge-generating layer is, for example, preferably 0.1 μm or more and 5.0 μm or less and is more preferably 0.2 μm or more and 2.0 μm or less.

Charge-Transporting Layer

The charge-transporting layer includes, for example, a charge-transporting material and a binder resin. The charge-transporting layer may include a polymeric charge-transporting material.

Examples of the charge-transporting material include, but are not limited to, the following electron-transporting compounds: quinones such as p-benzoquinone, chloranil, bromanil, and anthraquinone; tetracyanoquinodimethane compounds; fluorenones such as 2,4,7-trinitrofluorenone; xanthones; benzophenones; cyanovinyl compounds; and ethylenes. Examples of the charge-transporting material further include hole-transporting compounds such as triarylamines, benzidines, arylalkanes, aryl-substituted ethylenes, stilbenes, anthracenes, and hydrazones. The above charge-transporting materials may be used alone or in combination of two or more.

In particular, the triarylamine derivative represented by Structural Formula (a-1) below or the benzidine derivative represented by Structural Formula (a-2) below may be used as a charge-transporting material in consideration of the mobility of charge.

(a-1)

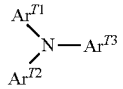

In Structural Formula (a-1), $Ar^{T1}$, $Ar^{T2}$, and $Ar^{T3}$ each independently represent an aryl group, a substituted aryl group, a $—C_6H_4—C(R^{T4})═C(R^{T5})(R^{T6})$ group, or a $—C_6H_4—CH═CH—CH═C(R^{T7})(R^{T8})$ group, where $R^{T4}$, $R^{T5}$, $R^{T6}$, $R^{T7}$, and $R^{T8}$ each independently represent a hydrogen atom, an alkyl group, a substituted alkyl group, an aryl group, or a substituted aryl group.

Examples of a substituent included in the above substituted groups include a halogen atom, an alkyl group having from 1 to 5 carbon atoms, an alkoxy group having from 1 to 5 carbon atoms, and an amino group substituted with an alkyl group having from 1 to 3 carbon atoms.

(a-2)

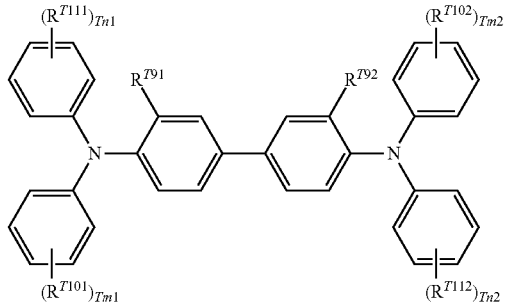

In Structural Formula (a-2), $R^{T91}$ and $R^{T92}$ each independently represent a hydrogen atom, a halogen atom, an alkyl group having from 1 to 5 carbon atoms, or an alkoxy group having from 1 to 5 carbon atoms; $R^{T101}$, $R^{T102}$, $R^{T111}$, and $R^{T112}$ each independently represent a halogen atom, an alkyl group having from 1 to 5 carbon atoms, an alkoxy group having from 1 to 5 carbon atoms, an amino group substituted with an alkyl group having from 1 or 2 carbon atoms, an aryl group, a substituted aryl group, a $—C(R^{T12})═C(R^{T13})(R^{T14})$ group, or a $—CH═CH—CH═C(R^{T15})(R^{T16})$ group, where $R^{T12}$, $R^{T13}$, $R^{T14}$, $R^{T15}$, and $R^{T16}$ each independently represent a hydrogen atom, an alkyl group, a substituted alkyl group, an aryl group, or a substituted aryl group; and Tm1, Tm2, Tn1, and Tn2 each independently represent an integer of from 0 to 2.

Examples of a substituent included in the above substituted groups include a halogen atom, an alkyl group having from 1 to 5 carbon atoms, an alkoxy group having from 1 to 5 carbon atoms, and an amino group substituted with an alkyl group having from 1 to 3 carbon atoms.

Among triarylamine derivatives represented by Structural Formula (a-1) above and benzidine derivatives represented by Structural Formula (a-2) above, in particular, a triarylamine derivative that includes the $—C_6H_4—CH═CH—CH═C(R^{T7})(R^{T8})$ group and a benzidine derivative that includes the $—CH═CH—CH═C(R^{T15})(R^{T16})$ group may be used in consideration of the mobility of charge.

The polymeric charge-transporting material may be any known charge-transporting compound such as poly-N-vinylcarbazole or polysilane. In particular, a polyester-based polymeric charge-transporting material may be used. The above polymeric charge-transporting materials may be used alone or in combination of the above binder resins.

Examples of the binder resin included in the charge-transporting layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among the above binder resins, in particular, a polycarbonate resin and a polyarylate resin may be used. The above binder resins may be used alone or in combination of two or more.

The binder resin included in the charge-transporting layer may be a biphenyl-copolymerization-type polycarbonate resin including a structural unit having a biphenyl skeleton (hereinafter, this biphenyl-copolymerization-type polycarbonate resin is referred to as "BP polycarbonate resin") in order to reduce the likelihood of the photosensitive layer becoming partially worn, enhance the abrasion resistance of the photosensitive layer (i.e., satisfy Formula (3)), and increase the service life of the photoreceptor.

Examples of the BP polycarbonate resin include a biphenyl-copolymerization-type polycarbonate resin that includes a structural unit represented by General Formula (PCA) below, which is a structural unit having a biphenyl skeleton, and a structural unit other than the structural unit represented by General Formula (PCA).

Examples of the other structural unit include structural units having a bisphenol skeleton such as bisphenol A, bisphenol B, bisphenol BP, bisphenol C, bisphenol F, or bisphenol Z.

A specific example of the BP polycarbonate resin is a copolymer of a dihydroxybiphenyl and a dihydroxy bisphenol. This copolymer may be produced by, for example, polycondensation of a dihydroxybiphenyl and a dihydroxy bisphenol, which are used as raw materials, with a carbonic-acid-ester-forming compound such as phosgene or transesterification of a dihydroxybiphenyl and a dihydroxy bisphenol with bisaryl carbonate.

A dihydroxybiphenyl is a biphenyl having a biphenyl skeleton including two benzene rings each having one hydroxyl group. Examples of the dihydroxybiphenyl include 4,4'-dihydroxybiphenyl, 4,4'-dihydroxy-3,3'-dimethylbiphenyl, 4,4'-dihydroxy-2,2'-dimethylbiphenyl, 4,4'-dihydroxy-3,3'-dicyclohexylbiphenyl, 3,3'-difluoro-4,4'-dihydroxybiphenyl, and 4,4'-dihydroxy-3,3'-diphenylbiphenyl.

The above dihydroxybiphenyls may be used alone or in combination of two or more.

A dihydroxy bisphenol is a bisphenol having a bisphenol skeleton including two benzene rings each having one hydroxyl group. Examples of the dihydroxy bisphenol include bis(4-hydroxyphenyl)methane, 1,1-bis(4-hydroxyphenyl)ethane, 1,2-bis(4-hydroxyphenyl)ethane, 2,2-bis(4-hydroxyphenyl)propane, 2,2-bis(3-methyl-4-hydroxyphenyl)butane, 2,2-bis(4-hydroxyphenyl)butane, 2,2-bis(4-hydroxyphenyl)octane, 4,4-bis(4-hydroxyphenyl)heptane, 1,1-bis(4-hydroxyphenyl)-1,1-diphenylmethane, 1,1-bis(4-hydroxyphenyl)-1-phenylethane, 1,1-bis(4-hydroxyphenyl)-1-phenylmethane, bis(4-hydroxyphenyl)ether, bis(4-hydroxyphenyl)sulfide, bis(4-hydroxyphenyl)sulfone, 1,1-bis(4-hydroxyphenyl)cyclopentane, 1,1-bis(4-hydroxyphenyl)cyclohexane, 2,2-bis(3-methyl-4-hydroxyphenyl)propane, 2-(3-methyl-4-hydroxyphenyl)-2-(4-hydroxyphenyl)-1-phenylethane, bis(3-methyl-4-hydroxyphenyl)sulfide, bis(3-methyl-4-hydroxyphenyl)sulfone, bis(3-methyl-4-hydroxyphenyl)methane, 1,1-bis(3-methyl-4-hydroxyphenyl)cyclohexane, 2,2-bis(2-methyl-4-hydroxyphenyl)propane, 1,1-bis(2-butyl-4-hydroxy-5-methylphenyl)butane, 1,1-bis(2-tert-butyl-4-hydroxy-3-methylphenyl)ethane, 1,1-bis(2-tert-butyl-4-hydroxy-5-methylphenyl)propane, 1,1-bis(2-tert-butyl-4-hydroxy-5-methylphenyl)butane, 1,1-bis(2-tert-butyl-4-hydroxy-5-methylphenyl)isobutane, 1,1-bis(2-tert-butyl-4-hydroxy-5-methylphenyl)heptane, 1,1-bis(2-tert-butyl-4-hydroxy-5-methylphenyl)-1-phenylmethane, 1,1-bis(2-tert-amyl-4-hydroxy-5-methylphenyl)butane, bis(3-chloro-4-hydroxyphenyl)methane, bis(3,5-dibromo-4-hydroxyphenyl)methane, 2,2-bis(3-chloro-4-hydroxyphenyl)propane, 2,2-bis(3-fluoro-4-hydroxyphenyl)propane, 2,2-bis(3-bromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl)propane, 2,2-bis(3-bromo-4-hydroxy-5-chlorophenyl)propane, 2,2-bis(3,5-dichloro-4-hydroxyphenyl)butane, 2,2-bis(3,5-dibromo-4-hydroxyphenyl)butane, 1-phenyl-1,1-bis(3-fluoro-4-hydroxyphenyl)ethane, bis(3-fluoro-4-hydroxyphenyl)ether, and 1,1-bis(3-cyclohexyl-4-hydroxyphenyl)cyclohexane.

The above bisphenols may be used alone or in combination of two or more.

Among the above BP polycarbonate resins, a polycarbonate resin that includes the structural unit represented by General Formula (PCA) and the structural unit represented by General Formula (PCB) may be used in order to reduce the likelihood of the photosensitive layer becoming partially worn, enhance the abrasion resistance of the photosensitive layer, and increase the service life of the photoreceptor.

(PCA)

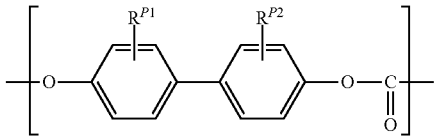

(PCB)

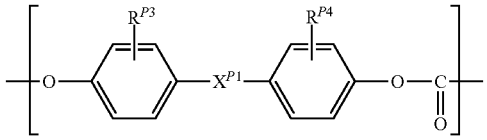

In General Formulae (PCA) and (PCB), $R^{P1}$, $R^{P2}$, $R^{P3}$, and $R^{P4}$ each independently represent a hydrogen atom, a halogen atom, an alkyl group having from 1 to 6 carbon atoms, a cycloalkyl group having from 5 to 7 carbon atoms, or an aryl group having from 6 to 12 carbon atoms; and $X^{P1}$ represents a phenylene group, a biphenylene group, a naphthylene group, an alkylene group, or a cycloalkylene group.

Examples of the alkyl group represented by $R^{P1}$, $R^{P2}$, $R^{P3}$, and $R^{P4}$ in General Formulae (PCA) and (PCB) include linear and branched alkyl groups having from 1 to 6 (preferably from 1 to 3) carbon atoms.

Specific examples of the linear alkyl group include a methyl group, an ethyl group, an n-propyl group, an n-butyl group, an n-pentyl group, and an n-hexyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, and a tert-hexyl group.

Among the above alkyl groups, lower alkyl groups such as a methyl group and an ethyl group are suitable.

Examples of the cycloalkyl group represented by $R^{P1}$, $R^{P2}$, $R^{P3}$, and $R^{P4}$ in General Formulae (PCA) and (PCB) include a cyclopentyl group, a cyclohexyl group, and a cycloheptyl group.

Examples of the aryl group represented by $R^{P1}$, $R^{P2}$, $R^{P3}$, and $R^{P4}$ in General Formulae (PCA) and (PCB) include a phenyl group, a naphthyl group, and a biphenylyl group.

Examples of the alkylene group represented by $X^{P1}$ in General Formulae (PCA) and (PCB) include linear and branched alkylene groups having from 1 to 12 (preferably from 1 to 6 and more preferably from 1 to 3) carbon atoms.

Specific examples of the linear alkylene group include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, and an n-dodecylene group.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, and a neododecylene group.

Among the above alkylene groups, lower alkylene groups such as a methylene group, an ethylene group, and a butylene group are suitable.

Examples of the cycloalkylene group represented by $X^{P1}$ in General Formulae (PCA) and (PCB) include cycloalkylene groups having from 3 to 12 (preferably from 3 to 10 and more preferably from 5 to 8) carbon atoms.

Specific examples of the cycloalkylene groups include a cyclopropylene group, a cyclopentylene group, a cyclohexylene group, a cyclooctylene group, and a cyclododecanylene group.

Among the above cycloalkylene groups, a cyclohexylene group is suitable.

The above groups represented by $R^{P1}$, $R^{P2}$, $R^{P3}$, $R^{P4}$, and $X^{P1}$ in General Formulae (PCA) and (PCB) may include a substituent. Examples of the substituent include halogen atoms such as a fluorine atom and a chlorine atom; alkyl groups such as an alkyl group having from 1 to 6 carbon atoms; cycloalkyl groups such as a cycloalkyl group having from 5 to 7 carbon atoms; alkoxy groups such as an alkoxy group having from 1 to 4 carbon atoms; and aryl groups such as a phenyl group, a naphthyl group, and a biphenylyl group.

The groups represented by $R^{P1}$ and $R^{P2}$ in General Formula (PCA) are each preferably a hydrogen atom or an alkyl group having from 1 to 6 carbon atoms and are each more preferably a hydrogen atom.

The groups represented by $R^{P3}$ and $R^{P4}$ in General Formula (PCB) may be each a hydrogen atom or an alkyl group having from 1 to 6 carbon atoms. The group represented by $X^{P1}$ may be an alkylene group or a cycloalkylene group.

Specific examples of the BP polycarbonate resin include, but are not limited to, the following compounds represented by Formulae (PC-1) to (PC-3). In Formulae (PC-1) to (PC-3), pm and pn represent a copolymerization ratio.

(PC-1)

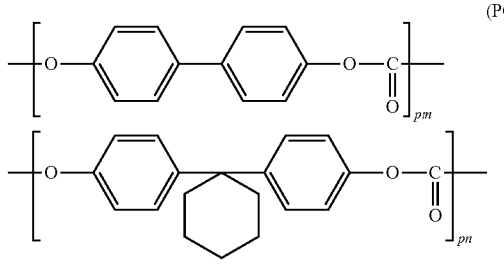

(PC-2)

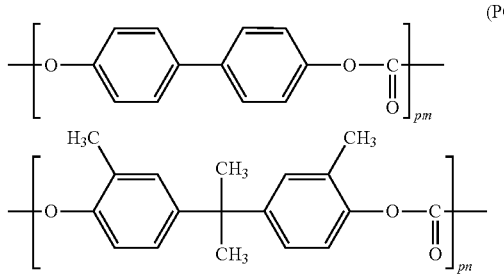

(PC-3)

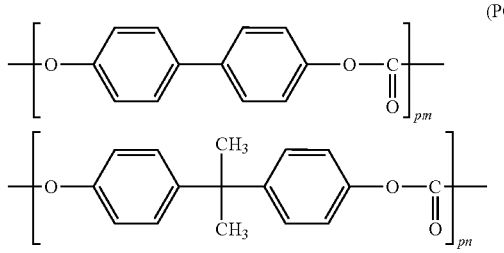

In the BP polycarbonate resin, the proportion of the amount of the structural unit represented by General Formula (PCA) to the total amount of all structural units constituting the BP polycarbonate resin, that is, the copolymerization ratio of the structural unit represented by General Formula (PCA), may be 5 mol % or more and 95 mol % or less, is preferably 5 mol % or more and 50 mol % or less, and is further preferably 15 mol % or more and 30 mol % or less in order to enhance the abrasion resistance of the photosensitive layer (i.e., the charge-transporting layer).

Specifically, in the above compounds that are examples of the BP polycarbonate resin, the copolymerization ratio (i.e., molar ratio) pm:pn may be 95:5 to 5:95, is preferably 50:50 to 5:95, and is further preferably 15:85 to 30:70.

In the case where the BP polycarbonate resin is used in combination with a binder resin other than the BP polycarbonate resin, the content of the other binder resin may be 10% by weight or less (preferably 5% by weight or less) of the total amount of binder resins.

The viscosity-average molecular weight of the binder resin (in particular, the BP polycarbonate resin) may be 40,000 or more and 80,000 or less in order to reduce the likelihood of the photosensitive layer becoming partially worn, enhance the abrasion resistance of the photosensitive layer (i.e., satisfy Formula (3)), and increase the service life of the photoreceptor and may be 40,000 or more and 60,000 or less in order to stabilize the coating liquid described below.

The viscosity-average molecular weight of the BP polycarbonate resin may be measured by the following method. In 100 $cm^3$ of methylene chloride, 1 g of the resin is dissolved uniformly, and the specific viscosity ηsp of the resulting solution is measured with an Ubbelohde viscometer at 25° C. Subsequently, the limiting viscosity [η] ($cm^3/g$) is determined on the basis of the relationship represented by $\eta sp/c=[\eta]+0.45[\eta]^2c$, where c represents the concentration ($g/cm^3$). Then, the viscosity-average molecular weight Mv is determined on the basis of the relationship represented by $[\eta]=1.23\times10^{-4}\ Mv^{0.83}$ given by H. Schnell.

The total content of the binder resins is preferably, for example, 10% by weight or more and 90% by weight or less, is more preferably 30% by weight or more and 90% by weight or less, and is further preferably 50% by weight or more and 90% by weight or less of the total solid content of the photosensitive layer (i.e., the charge-transporting layer).

The ratio between the total amount of binder resins and the amount of charge-transporting material (binder resins: charge-transporting material) may be 10:1 to 1:5 by weight.

The charge-transporting layer may optionally include known additives.

A method for forming the charge-transporting layer is not limited, and any known method may be employed. For example, the above components are dissolved in a solvent in order to form a coating liquid used for forming the charge-transporting layer (hereinafter, referred to as "charge-transporting-layer-forming coating liquid"). The charge-transporting-layer-forming coating liquid is formed into a coating film, which is dried and, as needed, subsequently heated.

Examples of the solvent used for preparing the charge-transporting-layer-forming coating liquid include the following common organic solvents: aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic and linear ethers such as tetrahydrofuran and ethyl ether. The above solvents may be used alone or in a mixture of two or more.

For applying the charge-transporting-layer-forming coating liquid onto the surface of the charge-generating layer, for example, the following common coating methods may be used: blade coating, wire bar coating, spray coating, dip coating, bead coating, air knife coating, and curtain coating.

The thickness of the charge-transporting layer is, for example, preferably 5 μm or more and 50 μm or less and is more preferably 10 μm or more and 30 μm or less.

Single-Layer Photosensitive Layer

A single-layer photosensitive layer (i.e., charge-generating and transporting layer) includes, for example, a charge-generating material, a charge-transporting material, and, as needed, a binder resin and known additives. These materials are the same as those described in Charge-Generating Layer and Charge-Transporting Layer above.

The amount of charge-generating material may be 10% by weight or more and 85% by weight or less and is preferably 20% by weight or more and 50% by weight or less of the total solid content of the single-layer photosensitive layer. The amount of charge-transporting material may be 5% by weight or more and 50% by weight or less of the total solid content of the single-layer photosensitive layer.

The single-layer photosensitive layer may be formed by the same method as the charge-generating layer and the charge-transporting layer.

The thickness of the single-layer photosensitive layer may be, for example, 5 μm or more and 50 μm or less and is preferably 10 μm or more and 40 μm or less.

Image-Forming Apparatus and Process Cartridge

An image-forming apparatus according to an exemplary embodiment includes an electrophotographic photoreceptor; a charging unit that charges the surface of the electrophotographic photoreceptor; an electrostatic-latent-image-forming unit that forms an electrostatic latent image on the charged surface of the electrophotographic photoreceptor; a developing unit including a developer-holding member including a developer held on the surface of the developer-holding member, the developer including a toner, the developer-holding member being arranged to be in contact with the surface of the electrophotographic photoreceptor such that an axial edge of the developer-holding member locates on the surface of an end portion A of the photosensitive layer and another axial edge of the developer-holding member locates on the surface of another end portion B of the photosensitive layer, the end portion A extending from a position 10 mm to a position 70 mm from an edge of the photosensitive layer toward the center of the photosensitive layer in the axial direction of the electrophotographic photoreceptor, the end portion B extending from a position 10 mm to a position 70 mm from another edge of the photosensitive layer toward the center of the photosensitive layer in the axial direction of the electrophotographic photoreceptor, the developing unit developing an electrostatic latent image formed on the surface of the electrophotographic photoreceptor with the developer held on the surface of the developer-holding member in order to form a toner image; and a transfer unit that transfers the toner image onto the surface of a recording medium. The electrophotographic photoreceptor is the electrophotographic photoreceptor according to the above-described exemplary embodiment.

The image-forming apparatus according to this exemplary embodiment may be implemented as any of the following known image-forming apparatuses: an image-forming apparatus that includes a fixing unit that fixes the toner image transferred on the surface of the recording medium; a direct-transfer image-forming apparatus that directly transfers the toner image formed on the surface of the electrophotographic photoreceptor onto the surface of a recording medium; an intermediate-transfer image-forming apparatus that transfers the toner image formed on the surface of the electrophotographic photoreceptor onto the surface of an intermediate transfer body (this process is referred to as "first transfer") and further transfers the toner image transferred on the surface of the intermediate transfer body onto the surface of a recording medium (this process is referred to as "second transfer"); an image-forming apparatus that includes a cleaning unit that cleans the surface of an electrophotographic photoreceptor which has not yet been charged after a toner image has been transferred; an image-forming apparatus that includes a charge-eliminating unit that irradiates, with charge-elimination light, the surface of an electrophotographic photoreceptor which has not yet been charged after a toner image has been transferred in order to eliminate charge; and an image-forming apparatus that includes an electrophotographic-photoreceptor-heating member that heats the electrophotographic photoreceptor in order to lower the relative humidity of the electrophotographic photoreceptor.

In the intermediate-transfer image-forming apparatus, the transfer unit includes, for example, an intermediate transfer body onto which a toner image is transferred, a first transfer unit that transfers a toner image formed on the surface of the electrophotographic photoreceptor onto the surface of the intermediate transfer body (first transfer), and a second transfer unit that transfers the toner image transferred on the surface of the intermediate transfer body onto the surface of a recording medium (second transfer).

The image-forming apparatus according to this exemplary embodiment may be a dry-developing image-forming apparatus or a wet-developing image-forming apparatus, which develops images with a liquid developer.

In the image-forming apparatus according to this exemplary embodiment, for example, a portion including the electrophotographic photoreceptor and the developing unit may have a cartridge structure, that is, may be a process cartridge, which is detachably attachable to the image-forming apparatus. The process cartridge may include, for example, the electrophotographic photoreceptor according to the above-described exemplary embodiment. The process cartridge may further include, for example, at least one component selected from the group consisting of the charging unit, the electrostatic-latent-image-forming unit, the developing unit, and the transfer unit.

An example of the image-forming apparatus according to this exemplary embodiment is described below. However, the image-forming apparatus is not limited to this. Hereinafter, only the components illustrated in the drawings are described, and the descriptions of the other components are omitted.

Figure 2:
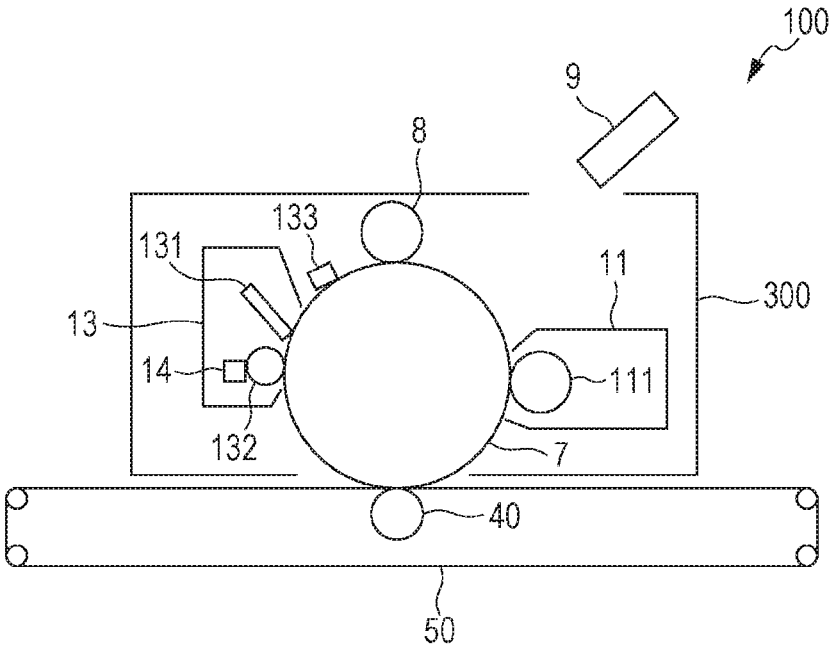
FIG. 2 is a schematic diagram illustrating an example of an image-forming apparatus according to an exemplary embodiment.

FIG. 2 schematically illustrates an example of the image-forming apparatus according to this exemplary embodiment.

As illustrated in FIG. 2, an image-forming apparatus 100 according to this exemplary embodiment includes a process cartridge 300 including an electrophotographic photoreceptor 7, an exposure device 9 (an example of the electrostatic-latent-image-forming unit), a transfer device 40 (i.e., first transfer device), and an intermediate transfer body 50. In the image-forming apparatus 100, the exposure device 9 is arranged such that the electrophotographic photoreceptor 7 is exposed to light emitted by the exposure device 9 through an aperture formed in the process cartridge 300; the transfer device 40 is arranged to face the electrophotographic photoreceptor 7 with the intermediate transfer body 50 interposed therebetween; and the intermediate transfer body 50 is arranged such that part of the intermediate transfer body 50 comes into contact with the electrophotographic photoreceptor 7. Although not illustrated in the drawing, the image-forming apparatus 100 also includes a second transfer device that transfers a toner image transferred on the intermediate transfer body 50 onto a recording medium such as paper. In the image-forming apparatus 100, the intermediate transfer body 50, the transfer device 40 (i.e., first transfer device), and the second transfer device (not illustrated) correspond to an example of the transfer unit.

The process cartridge 300 illustrated in FIG. 2 includes the electrophotographic photoreceptor 7, a charging device 8 (an example of the charging unit), a developing device 11 (an example of the developing unit), and a cleaning device 13 (an example of the cleaning unit), which are integrally supported inside a housing. The cleaning device 13 includes a cleaning blade 131 (an example of the cleaning member), which is arranged to come into contact with the surface of the electrophotographic photoreceptor 7. The form of the cleaning member is not limited to the cleaning blade 131 and may be, for example, a conductive or insulating fibrous member. The conductive or insulating fibrous member may be used alone or in combination with the cleaning blade 131.

The image-forming apparatus illustrated in FIG. 2 includes a roller-like, fibrous member 132 with which a lubricant 14 is fed onto the surface of the electrophotographic photoreceptor 7 and a flat-brush-like, fibrous member 133 that assists cleaning. However, the image-forming apparatus illustrated in FIG. 2 is merely an example, and the fibrous members 132 and 133 are optional.

The components of the image-forming apparatus according to this exemplary embodiment are each described below.

Charging Device

Examples of the charging device 8 include contact chargers that include, for example, a charging roller, a charging brush, a charging film, a charging rubber blade, or a charging tube that are conductive or semiconductive; contactless roller chargers; and known chargers such as a scorotron charger and a corotron charger that utilize corona discharge.

Exposure Device

The exposure device 9 may be, for example, an optical device with which the surface of the electrophotographic photoreceptor 7 can be exposed to light emitted by a semiconductor laser, an LED, a liquid-crystal shutter, or the like in a predetermined image pattern. The wavelength of the light source is set to fall within the range of the spectral sensitivity of the electrophotographic photoreceptor. Although common semiconductor lasers have an oscillation wavelength in the vicinity of 780 nm, that is, the near-infrared region, the wavelength of the light source is not limited to this; semiconductor lasers having an oscillation wavelength of about 600 to 700 nm and blue semiconductor lasers having an oscillation wavelength of 400 nm or more and 450 nm or less may also be used. For forming color images, surface-emitting lasers capable of emitting multi beam may be used as a light source.

Developing Device

The developing device 11 is a contact developing device. Specifically, the developing device 11 includes, for example, a developing roller 111 (an example of the developer-holding member). The developing roller 111 is arranged to be in contact with the surface of the electrophotographic photoreceptor 7 (i.e., the photosensitive layer included in the electrophotographic photoreceptor 7). The developing roller 111 is arranged to be in contact with the surface of the photosensitive layer of the electrophotographic photoreceptor while, for example, a load is applied to both axial end portions of the developing roller 111. The developing roller 111 is arranged such that an axial edge of the developing roller 111 locates on the surface of the end portion A of the photosensitive layer and the other axial edge of the developing roller 111 locates on the surface of the other end portion B of the photosensitive layer (see FIG. 4).

The developing roller 111 includes the developer held on the surface thereof. When the developing roller 111 is rotated, the developer is transported to the position at which the developing roller 111 faces the surface of the electrophotographic photoreceptor 7, and an electrostatic latent image formed on the surface of the electrophotographic photoreceptor 7 is developed with the developer to form a toner image.

The type of the developing device 11 is not limited. Any known contact developing device may be used.

The developer included in the developing device 11 may be a one-component developer including only a toner or a two-component developer including a toner and a carrier. The developer may be magnetic or nonmagnetic. Known developers may be used as a developer included in the developing device 11.

Cleaning Device

The cleaning device 13 may be, for example, a cleaning-blade-type cleaning device including a cleaning blade 131.

The type of the cleaning device 13 is not limited to the cleaning-blade-type cleaning device, and a fur-brush-cleaning-type cleaning device may also be used. In another case, cleaning and development may be performed at the same time.

Transfer Device

The transfer device 40 may be, for example, any of the following known transfer chargers: contact transfer chargers including a belt, a roller, a film, a rubber blade, or the like; and transfer chargers which utilize corona discharge, such as a scorotron and a corotron.

Intermediate Transfer Body

The intermediate transfer body 50 may be, for example, a belt-like intermediate transfer body, that is, an intermediate transfer belt, including polyimide, polyamideimide, polycarbonate, polyarylate, polyester, a rubber, or the like that is made semiconductive. The intermediate transfer body is not limited to a belt-like intermediate transfer body and may be a drum-like intermediate transfer body.

Figure 3:
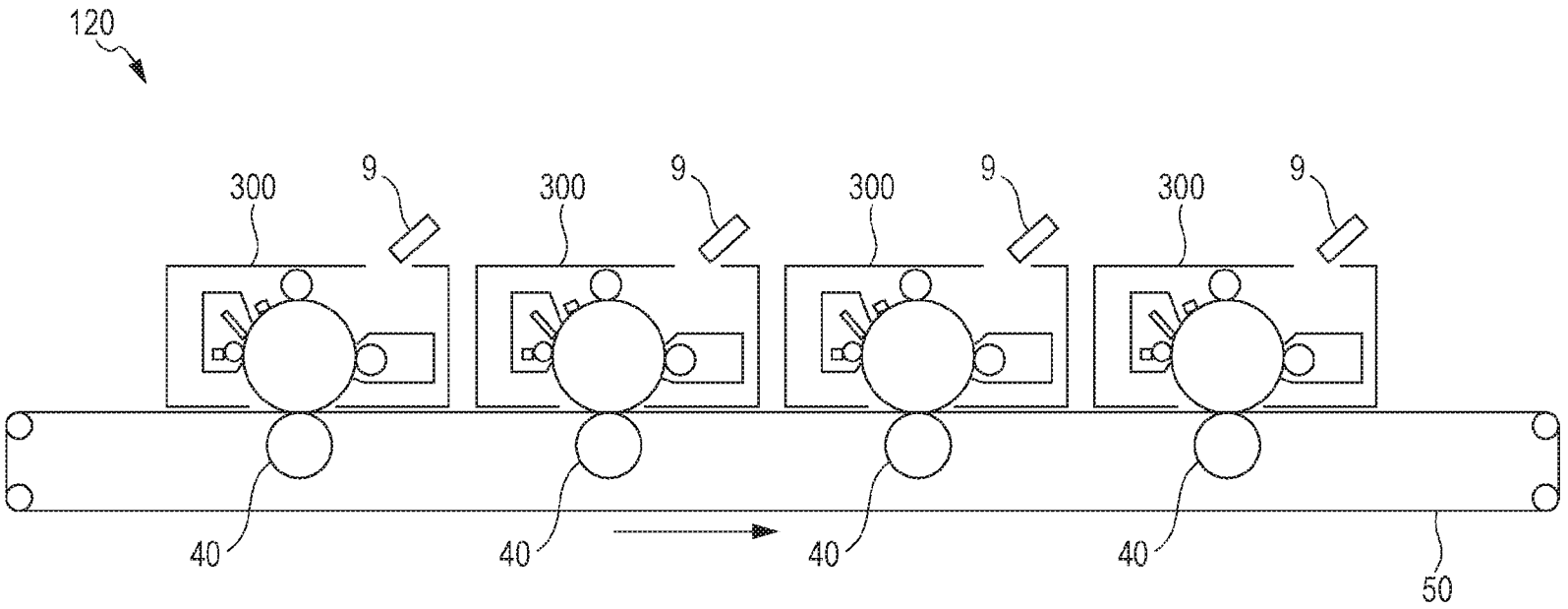
FIG. 3 is a schematic diagram illustrating another example of an image-forming apparatus according to an exemplary embodiment.

FIG. 3 schematically illustrates another example of the image-forming apparatus according to this exemplary embodiment.

An image-forming apparatus 120 illustrated in FIG. 3 is a tandem, multi-color image-forming apparatus including four process cartridges 300. In the image-forming apparatus 120, the four process cartridges 300 are arranged in parallel to one another on an intermediate transfer body 50, and one electrophotographic photoreceptor is used for one color. The image-forming apparatus 120 has the same structure as the image-forming apparatus 100 except that the image-forming apparatus 120 is tandem.

EXAMPLES

The above-described exemplary embodiments are described with reference to Examples below. The present invention is not limited by Examples below. Hereinafter, all "part" and "%" refer to "part by weight" and "% by weight", respectively, unless otherwise specified.

Example 1

With 500 parts by weight of methanol, 100 parts by weight of zinc oxide produced by TAYCA CORPORATION (average particle diameter: 70 nm, specific surface area: 15 $m^2/g$) is mixed while being stirred. To the resulting mixture, 0.75 parts by weight of a silane coupling agent "KBM603" produced by Shin-Etsu Chemical Co., Ltd. is added, and the mixture is subsequently stirred for two hours. The mixture is then subjected to distillation under a reduced pressure in order to remove methanol. Subsequently, baking is performed at 120° C. for 3 hours. Thus, zinc oxide particles having surfaces treated with a silane coupling agent are prepared.

With 85 parts by weight of methyl ethyl ketone, 60 parts by weight of the surface-treated zinc oxide particles, 1.2 parts by weight of alizarin, which serves as a reactive acceptor substance, 13.5 parts by weight of a blocked isocyanate "Sumidur 3173" produced by Sumitomo Bayer Urethane Co., Ltd., which serves as a curing agent, and 15 parts by weight of a butyral resin "S-LEC BM-1" produced by SEKISUI CHEMICAL CO., LTD. are mixed. Then, 38 parts by weight of the resulting liquid mixture is mixed with 25 parts by weight of methyl ethyl ketone. The resulting mixture is dispersed for 4 hours with a sand mill including glass beads having a diameter of 1 mm. Thus, a dispersion liquid is formed. To the dispersion liquid, 0.005 parts by weight of dioctyltin dilaurate, which serves as a catalyst, and 4.0 parts by weight of silicone resin particles "Tospearl 145" produced by Momentive Performance Materials Inc. are added. Thus, an undercoat-layer-forming coating liquid is prepared. The viscosity of the undercoat-layer-forming coating liquid at the coating temperature (24° C.) is 235 mPa·s.

The coating liquid is applied to an aluminum support having a diameter of 40 mm by dip coating at a coating speed of 220 mm/min. The resulting coating film is dried at 180° C. for 40 minutes and cured. Thus, an undercoat layer having a thickness of 19 μm is formed.

With 15 parts by weight of a hydroxygallium phthalocyanine pigment having strong diffraction peaks at, at least, Bragg angles (2θ±0.2°) of 7.5°, 9.9°, 12.5°, 16.3°, 18.6°, 25.1°, and 28.3° when being irradiated with the CuKα radiation, which serves as a charge-generating material, 10 parts by weight of a vinyl chloride-vinyl acetate copolymer "VMCH" produced by Nippon Union Carbide Co. and 300 parts by weight of n-butyl alcohol are mixed. The resulting mixture is dispersed for 4 hours with a sand mill including glass beads having a diameter of 1 mm. Thus, a charge-generating-layer-forming coating liquid is prepared. The viscosity of the charge-generating-layer-forming coating liquid at the coating temperature (24° C.) is 1.8 mPa·s. The above coating liquid is applied to the undercoat layer by dip coating at a coating speed of 65 mm/min. The resulting coating film is dried at 150° C. for 10 minutes. Thus, a charge-generating layer is formed.

Subsequently, 8 parts by weight of tetrafluoroethylene resin particles having an average particle diameter of 0.2 μm are mixed with 0.01 parts by weight of a fluoroalkyl-group-containing methacryl copolymer "GF400" produced by Toagosei Co., Ltd., 4 parts by weight of tetrahydrofuran (THF), and 1 part by weight of toluene. The resulting liquid mixture is stirred for 48 hours while the temperature of the liquid mixture is maintained at 20° C. Thus, a tetrafluoroethylene resin particle suspension A is formed.

In 32 parts by weight of tetrahydrofuran (THF) and 3 parts by weight of toluene, which serve as solvents, 1.6 parts by weight of the compound (CTIA) and 3 parts by weight of N,N'-bis(3-methylphenyl)-N,N'-diphenylbenzidine (i.e., the compound (CT2A)), which serve as charge-transporting substances, 6 parts by weight of a polycarbonate copolymer (i.e., the compound (PC-A) described below in detail), which serves as a binder resin, and 0.1 parts by weight of 2,6-di-t-butyl-4-methylphenol, which serves as an antioxidant, are dissolved. Thus, a mixed solution B is prepared.

(CT1A)

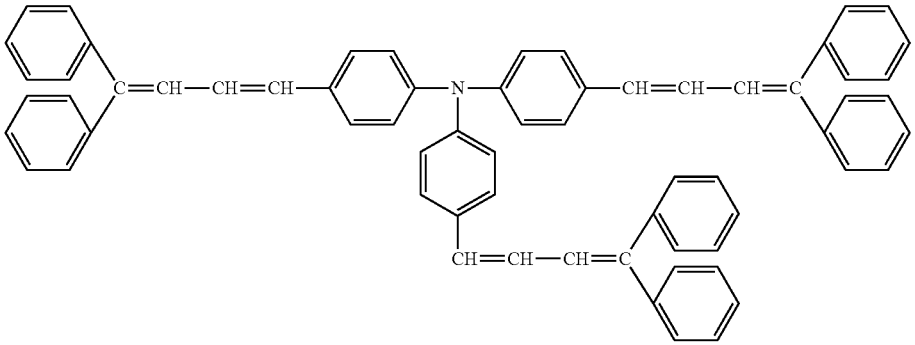

(CT2A)

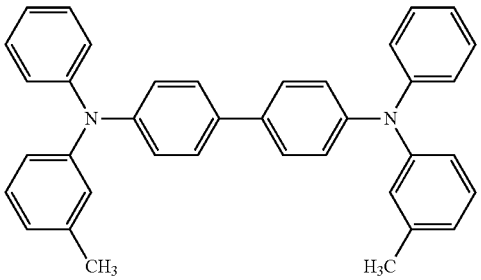

The tetrafluoroethylene particle suspension A is added to the mixed solution B, and the resulting mixture is stirred. The mixture is dispersed by increasing the pressure to 500 kgf/cm$^2$ with a high-pressure homogenizer produced by Yoshida Kikai Co., Ltd. which includes a through-type chamber in which a narrow channel is formed. This dispersion treatment is repeated six times. To the resulting dispersion liquid, an ether-modified silicone oil "KP340" produced by Shin-Etsu Chemical Co., Ltd. is added at a concentration of 5 ppm. The resulting mixture is stirred. Thus, a charge-transporting-layer-forming coating liquid is prepared. The coating liquid is applied to the charge-generating layer such that the thickness of the resulting coating film is 40 μm.

While the aluminum support including the coating film formed thereon using a charge-transporting-layer-forming coating liquid is rotated, warm air is blown over the entirety of the coating film with a halogen lamp being disposed on each axial end of the support in order to dry the coating film. The coating film is dried under the conditions that a portion of the coating film which corresponds to the end portion A of the charge-transporting layer (i.e., the photosensitive layer) is dried at 143° C., a portion of the coating film which corresponds to the other end portion B of the charge-transporting layer (i.e., the photosensitive layer) is dried at 143° C., and a portion of the coating film which corresponds to the central portion C of the charge-transporting layer (i.e., the photosensitive layer) is dried at 115° C. Thus, a charge-transporting layer is formed.

The photoreceptor of Example 1 is prepared in the above-described manner.

Examples 2 to 4 and Comparative Examples 1 to 4

In Examples 2 to 4 and Comparative examples 1 to 4, a photoreceptor is prepared as in Example 1, except that the following conditions of the formation of the charge-transporting layer are changed as described in Table 1:

1) Type of the binder resin,

2) The content of the solvent in the charge-transporting-layer-forming coating liquid, and 3) The drying conditions in the formation of the charge-transporting layer, that is, specifically, the temperature at which a portion of the coating film which corresponds to the end portion A of the charge-transporting layer, that is, the photosensitive layer, is dried (in Table 1, referred to as "Drying temperature of end portion A"), the temperature at which a portion of the coating film which corresponds to the other end portion B of the charge-transporting layer, that is, the photosensitive layer, is dried (in Table 1, referred to as "Drying temperature of other end portion B"), and the temperature at which a portion of the coating film which corresponds to the central portion C of the charge-transporting layer, that is, the photosensitive layer, is dried (in Table 1, referred to as "Drying temperature of central portion C").

Measurement

The Young's moduli of the surface of the photosensitive layer, that is, specifically, the Young's modulus YA (MPa) of the end portion A, the Young's modulus YB (MPa) of the other end portion B, and the Young's modulus YC (MPa) of the central portion C of the charge-transporting layer (i.e., the photosensitive layer), included in the photoreceptor prepared in each of Examples 1 to 4 and Comparative examples 1 to 4 are measured by the above-described method.

Evaluation

The photoreceptor prepared in each of Examples 1 to 4 and Comparative examples 1 to 4 is attached to a modification of an image-forming apparatus "DocuCentre-IV C5570" produced by Fuji Xerox Co., Ltd., which includes a contact developing device. In the image-forming apparatus including the photoreceptor, an axial edge of a developing roller included in the developing device is in contact with the end portion A of the charge-transporting layer (i.e., the photosensitive layer) included in the photoreceptor, and the other axial edge of the developing roller is in contact with the other end portion B of the charge-transporting layer (i.e., the photosensitive layer) included in the photoreceptor.

The following evaluations are made using the above image-forming apparatus.

Black Strip-Like Image Defects

A lattice pattern is printed on 100,000 A3-size paper sheets under the conditions of 10° C. and 15% RH. Subsequently, a halftone image is printed over the entirety of an A3-size paper sheet at an image density of 50%, and the halftone image is visually inspected for black strip-like image defects that may occur at the edges of the paper sheet in the transport direction and the direction orthogonal to the transport direction. The evaluation is made in accordance with the following standards.

Evaluation Standards

A: Black strip-like defects are not present at the edges of the paper sheet.

B: Slight black strip-like defects are present at the edges of the paper sheet.

C: Black strip-like defects are present at the edges of the paper sheet.

D: Severe black strip-like defects are present at the edges of the paper sheet.

Partial Wearing of Charge-Transporting Layer and Service Life of Photoreceptor

A lattice pattern is printed on 100,000 A3-size paper sheets under the conditions of 10° C. and 15% RH. Subsequently, a halftone image is printed over the entirety of an A3-size paper sheet at an image density of 50%. Then, the photoreceptor is removed from the image-forming apparatus. The thicknesses of end portions of the charge-transporting layer (i.e., the photosensitive layer) of the photoreceptor, which were in contact with the respective axial edges of the developing roller, are measured. The thickness of the central portion of the charge-transporting layer (i.e., the photosensitive layer) in the axial direction of the photoreceptor is measured. The thicknesses of the charge-transporting layer (i.e., the photosensitive layer) are measured with an eddy-current thickness gage produced by Fischer Instruments K.K. The partial wearing of the charge-transporting layer (i.e., the photosensitive layer) and the service life of the photoreceptor are evaluated in accordance with the evaluation standards below.

Standards for Evaluation of Partial Wearing of Charge-Transporting Layer (i.e., Photosensitive Layer)

A: The difference in thickness between the end portions and the center of the charge-transporting layer (i.e., the photosensitive layer) is 1.0 μm or less.

B: The difference in thickness between the end portions and the center of the charge-transporting layer (i.e., the photosensitive layer) is more than 1.0 μm and 3.0 μm or less.

C: The difference in thickness between the end portions and the center of the charge-transporting layer (i.e., the photosensitive layer) is more than 3.0 μm and 5.0 μm or less.

D: The difference in thickness between the end portions and the center of the charge-transporting layer (i.e., the photosensitive layer) is more than 5.0 μm.

Standards for Evaluation of Service Life of Photoreceptor

A: The thickness of the central portion of the charge-transporting layer (i.e., the photosensitive layer) is 20 μm or more.

B: The thickness of the central portion of the charge-transporting layer (i.e., the photosensitive layer) is 18 μm or more and less than 20 μm.

C: The thickness of the central portion of the charge-transporting layer (i.e., the photosensitive layer) is 15 μm or more and less than 18 μm.

D: The thickness of the central portion of the charge-transporting layer (i.e., the photosensitive layer) is less than 15 μm.

TABLE 1

| | Binder resin | | Solvent included in charge-transporting-layer-forming coating liquid | | | Drying conditions in formation of charge-transporting layer | | |
|---|---|---|---|---|---|---|---|---|
| | | | | | | Drying temperature of end portion A | Drying temperature of central portion C | Drying temperature of other end portion B |
| | Type | Mz | THF (Part) | Toluene (Part) | THF/Toluene (ratio) | (° C.) | (° C.) | (° C.) |
| Example 1 | PC-A | 45000 | 36 | 4 | 9/1 | 143 | 115 | 143 |
| Example 2 | PC-A | 45000 | 36 | 4 | 9/1 | 143 | 130 | 143 |
| Example 3 | PC-B | 40000 | 36 | 4 | 9/1 | 143 | 130 | 143 |
| Example 4 | PC-A | 45000 | 28 | 12 | 7/3 | 143 | 130 | 143 |
| Comparative example 1 | PC-A | 45000 | 36 | 4 | 9/1 | 143 | 143 | 143 |
| Comparative example 2 | PC-A | 45000 | 36 | 4 | 9/1 | 115 | 115 | 115 |
| Comparative example 3 | PC-A | 45000 | 28 | 12 | 7/3 | 143 | 115 | 143 |
| Comparative example 4 | PC-C | 35000 | 36 | 4 | 9/1 | 143 | 130 | 143 |

| | Young's modulus of surface of charge-transporting layer (MPa) | | | | | Evaluations | | |
|---|---|---|---|---|---|---|---|---|
| | | | | | | Black strip-like image | Partial wearing of charge-transporting | Service life of |
| | YA | YB | YC | YC − YA | YC − YB | defects | layer | photoreceptor |
| Example 1 | 4.13 | 4.17 | 4.35 | 0.22 | 0.18 | A | A | B |
| Example 2 | 4.12 | 4.14 | 4.24 | 0.12 | 0.10 | B | B | A |

TABLE 1-continued

| | | | | | | | | |
|---|---|---|---|---|---|---|---|---|
| Example 3 | 4.27 | 4.28 | 4.40 | 0.13 | 0.12 | B | B | B |
| Example 4 | 4.30 | 4.31 | 4.41 | 0.11 | 0.10 | B | B | B |
| Comparative example 1 | 4.10 | 4.15 | 4.13 | 0.03 | 0.02 | D | D | A |
| Comparative example 2 | 4.33 | 4.37 | 4.35 | 0.02 | 0.02 | D | D | C |
| Comparative example 3 | 4.37 | 4.39 | 4.52 | 0.15 | 0.13 | B | B | D |
| Comparative example 4 | 4.50 | 4.52 | 4.60 | 0.10 | 0.08 | B | B | D |

The above results confirm that the photoreceptors prepared in Examples each reduce the likelihood of the end portions of the charge-transporting layer (i.e., the photosensitive layer) in the axial direction of the photoreceptor, which are in contact with the respective axial edges of the developing roller, becoming worn compared with those prepared in Comparative examples. Furthermore, it is confirmed that the occurrence of black strip-like image defects, which are caused as a result of the partial wearing of the photoreceptor, is also reduced.

In Examples, the wearing of the charge-transporting layer (i.e., the photosensitive layer) is also reduced. That is, the photoreceptors prepared in Examples may have a long service life.

The detail of the abbreviations used in Table 1 is described below.

Binder Resin

PC-A: Compound (PC-1), pm/pn ratio: 25/75, viscosity-average molecular weight Mz: 45,000

PC-B: Compound (PC-1), pm/pn ratio: 25/75, viscosity-average molecular weight Mz: 40,000

PC-C: Compound (PC-1), pm/pn ratio: 25/75, viscosity-average molecular weight Mz: 35,000

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer disposed on the conductive substrate, the photosensitive layer serving as an outermost surface of the electrophotographic photoreceptor, wherein YA, YB, and YC satisfy Formulae from (1) to (3) below:

$$YC-YA \geq 0.1 \text{ MPa} \quad (1)$$

$$YC-YB \geq 0.1 \text{ MPa} \quad (2)$$

$$YC \leq 4.5 \text{ MPa} \quad (3),$$

wherein YA, YB, and YC (MPa) each represent the Young's modulus of a surface of the photosensitive layer determined by nanoindentation at an indentation depth of 500 nm, YA being measured at an end portion A of the photosensitive layer, the end portion A extending from a position 10 mm to a position 70 mm from an edge of the photosensitive layer toward the center of the photosensitive layer in an axial direction of the electrophotographic photoreceptor, YB being measured at another end portion B of the photosensitive layer, the end portion B extending from a position 10 mm to a position 70 mm from another edge of the photosensitive layer toward the center of the photosensitive layer in the axial direction of the electrophotographic photoreceptor, YC being measured at a central portion C of the photosensitive layer, the central portion C extending from a position 20 mm in front of and to a position 20 mm behind the center of the photosensitive layer in the axial direction of the electrophotographic photoreceptor.

2. The electrophotographic photoreceptor according to claim 1, wherein YC−YA in Formula (1) is 0.5 MPa or less.

3. The electrophotographic photoreceptor according to claim 1, wherein YC−YB in Formula (2) is 0.5 MPa or less.

4. The electrophotographic photoreceptor according to claim 1, wherein YC in Formula (1) is 4.0 MPa or more.

5. The electrophotographic photoreceptor according to claim 1, wherein the Young's modulus of the surface of the photosensitive layer gradually increases in the directions from the end portion A and the other end portion B to the central portion C.

6. An electrophotographic photoreceptor comprising:

a conductive substrate; and a photosensitive layer disposed on the conductive substrate, the photosensitive layer serving as an outermost surface of the electrophotographic photoreceptor, wherein YA, YB, and YC satisfy Formulae from (1) to (3) below:

$$YC-YA \geq 0.1 \text{ MPa} \quad (1)$$

$$YC-YB \geq 0.1 \text{ MPa} \quad (2)$$

$$YC \leq 4.5 \text{ MPa} \quad (3),$$

wherein YA, YB, and YC (MPa) each represent the Young's modulus of a surface of the photosensitive layer determined by nanoindentation at an indentation depth of 500 nm, YA being measured at an end portion A of the photosensitive layer, the end portion A extending from a position 10 mm to a position 70 mm from an edge of the photosensitive layer toward the center of the photosensitive layer in an axial direction of the electrophotographic photoreceptor, YB being measured at another end portion B of the photosensitive layer, the end portion B extending from a position 10 mm to a position 70 mm from another edge of the photosensitive layer toward the center of the photosensitive layer in the axial direction of the electrophotographic photoreceptor, YC being measured at a central portion C of the photosensitive layer, the central portion C extending from a position 20 mm in front of and to a position 20 mm behind the center of the photosensitive layer in the axial direction of the electrophotographic photoreceptor, wherein the photosensitive layer includes a charge-transporting layer serving as an outermost sublayer thereof, and the charge-transporting layer including a biphenyl-copolymerization-type polycarbonate resin including a structural unit having a biphenyl skeleton.

7. The electrophotographic photoreceptor according to claim 6, wherein the biphenyl-copolymerization-type polycarbonate resin is a polycarbonate resin including a structural unit represented by General Formula (PCA) below and a structural unit represented by General Formula (PCB) below, (PCA)

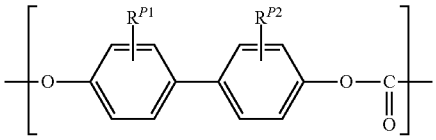

(PCB)

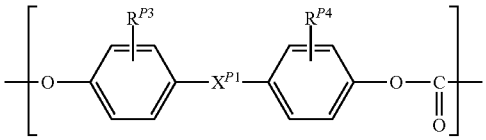

where, $R^{P1}$, $R^{P2}$, $R^{P3}$, and $R^{P4}$ each independently represent a hydrogen atom, a halogen atom, an alkyl group having from 1 to 6 carbon atoms, a cycloalkyl group having from 5 to 7 carbon atoms, or an aryl group having from 6 to 12 carbon atoms; and $X^{P1}$ represents a phenylene group, a biphenylene group, a naphthylene group, an alkylene group, or a cycloalkylene group.

8. An electrophotographic photoreceptor comprising:

a conductive substrate; and a photosensitive layer disposed on the conductive substrate, the photosensitive layer serving as an outermost surface of the electrophotographic photoreceptor, wherein YA, YB, and YC satisfy Formulae from (1) to (3) below:

$$YC-YA \geq 0.1 \text{ MPa} \quad (1)$$

$$YC-YB \geq 0.1 \text{ MPa} \quad (2)$$

$$YC \leq 4.5 \text{ MPa} \quad (3),$$

wherein YA, YB, and YC (MPa) each represent the Young's modulus of a surface of the photosensitive layer determined by nanoindentation at an indentation depth of 500 nm, YA being measured at an end portion A of the photosensitive layer, the end portion A extending from a position 10 mm to a position 70 mm from an edge of the photosensitive layer toward the center of the photosensitive layer in an axial direction of the electrophotographic photoreceptor, YB being measured at another end portion B of the photosensitive layer, the end portion B extending from a position 10 mm to a position 70 mm from another edge of the photosensitive layer toward the center of the photosensitive layer in the axial direction of the electrophotographic photoreceptor, YC being measured at a central portion C of the photosensitive layer, the central portion C extending from a position 20 mm in front of and to a position 20 mm behind the center of the photosensitive layer in the axial direction of the electrophotographic photoreceptor, wherein the photosensitive layer is a single-layer photosensitive layer, and the single-layer photosensitive layer including a biphenyl-copolymerization-type polycarbonate resin including a structural unit having a biphenyl skeleton.

9. The electrophotographic photoreceptor according to claim 8, wherein the biphenyl-copolymerization-type polycarbonate resin is a polycarbonate resin including a structural unit represented by General Formula (PCA) below and a structural unit represented by General Formula (PCB) below, (PCA)

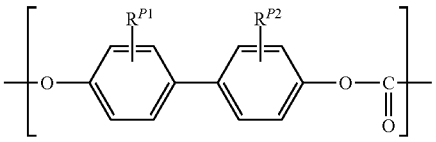

(PCB)

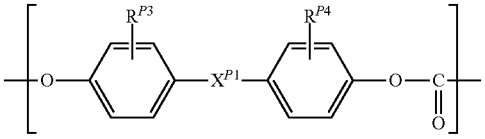

where, $R^{P1}$, $R^{P2}$, $R^{P3}$, and $R^{P4}$ each independently represent a hydrogen atom, a halogen atom, an alkyl group having from 1 to 6 carbon atoms, a cycloalkyl group having from 5 to 7 carbon atoms, or an aryl group having from 6 to 12 carbon atoms; and $X^{P1}$ represents a phenylene group, a biphenylene group, a naphthylene group, an alkylene group, or a cycloalkylene group.

10. A process cartridge detachably attachable to an image-forming apparatus, the process cartridge comprising:

the electrophotographic photoreceptor according to claim 1; and a developing unit including a developer-holding member including a developer held on a surface of the developer-holding member, the developer including a toner, the developer-holding member being arranged to be in contact with a surface of the electrophotographic photoreceptor such that an axial edge of the developer-holding member locates on a surface of an end portion A of the photosensitive layer and another axial edge of the developer-holding member locates on a surface of another end portion B of the photosensitive layer, the end portion A extending from a position 10 mm to a position 70 mm from an edge of the photosensitive layer toward the center of the photosensitive layer in an axial direction of the electrophotographic photoreceptor, the end portion B extending from a position 10 mm to a position 70 mm from another edge of the photosensitive layer toward the center of the photosensitive layer in the axial direction of the electrophotographic photoreceptor, the developing unit developing an electrostatic latent image formed on the surface of the electrophotographic photoreceptor with the developer held on the surface of the developer-holding member to form a toner image.

11. An image-forming apparatus comprising:

the electrophotographic photoreceptor according to claim 1;

a charging unit that charges a surface of the electrophotographic photoreceptor;

an electrostatic-latent-image-forming unit that forms an electrostatic latent image on the charged surface of the electrophotographic photoreceptor;

a developing unit including a developer-holding member including a developer held on a surface of the developer-holding member, the developer including a toner, the developer-holding member being arranged to be in contact with the surface of the electrophotographic photoreceptor such that an axial edge of the developer-holding member locates on a surface of an end portion A of the photosensitive layer and another axial edge of the developer-holding member locates on a surface of another end portion B of the photosensitive layer, the end portion A extending from a position 10 mm to a position 70 mm from an edge of the photosensitive layer toward the center of the photosensitive layer in an axial direction of the electrophotographic photoreceptor, the end portion B extending from a position 10 mm to a position 70 mm from another edge of the photosensitive layer toward the center of the photosensitive layer in the axial direction of the electrophotographic photoreceptor, the developing unit developing the electrostatic latent image formed on the surface of the electrophotographic photoreceptor with the developer held on the surface of the developer-holding member to form a toner image; and a transfer unit that transfers the toner image onto a surface of a recording medium.

* * * * *